US010131469B2

(12) United States Patent
Thies

(10) Patent No.: US 10,131,469 B2
(45) Date of Patent: Nov. 20, 2018

(54) BAG, METHOD FOR THE PRODUCTION OF A BAG AND MACHINE SYSTEM FOR THE PRODUCTION OF A BAG

(71) Applicant: Windmöller & Hölscher KG, Lengerich (DE)

(72) Inventor: Jörg Christian Thies, Dissen (DE)

(73) Assignee: Windmöller & Hölscher KG, Lengerich (DE)

( * ) Notice: Subject to any disclaimer, the term of this patent is extended or adjusted under 35 U.S.C. 154(b) by 0 days.

(21) Appl. No.: 14/893,535

(22) PCT Filed: Feb. 26, 2014

(86) PCT No.: PCT/EP2014/053758

§ 371 (c)(1),
(2) Date: Nov. 24, 2015

(87) PCT Pub. No.: WO2014/187582

PCT Pub. Date: Nov. 27, 2014

(65) Prior Publication Data

US 2016/0130039 A1 May 12, 2016

(30) Foreign Application Priority Data

May 24, 2013 (DE) ..... 10 2013 105 381

(51) Int. Cl.
*B65D 33/06* (2006.01)
*B65D 33/10* (2006.01)
(Continued)

(52) U.S. Cl.
CPC ..... *B65D 33/06* (2013.01); *B31B 1/86* (2013.01); *B65D 33/004* (2013.01);
(Continued)

(58) Field of Classification Search
CPC .... B65D 33/06; B65D 33/004; B65D 33/007; B65D 33/04; B65D 33/105;
(Continued)

(56) References Cited

U.S. PATENT DOCUMENTS 2,985,355 A * 5/1961 Read ..... B65D 33/02 383/122
3,439,591 A * 4/1969 Class ..... B31B 19/86 383/20
(Continued)

FOREIGN PATENT DOCUMENTS

DE 1611657 1/1971
DE 2048485 4/1971
(Continued)

OTHER PUBLICATIONS

Translation Dated Mar. 21, 2016 of Pruefungsantrag [Request for Examination] Dated Feb. 10, 2014 From the Deutsches Patent—und Markenamt [German Patent and Trademark Office] Re. Application No. 102013105381.5.
(Continued)

*Primary Examiner* — Peter Helvey

(57) ABSTRACT

The invention relates to a bag (10) comprising a front wall (11) and a back wall (12) arranged parallel to the front wall (11), a bottom (13) that can be folded into the plane of the walls (11, 12), such that a filling chamber (14) results that is open on one side, and a pair of carrying handles (31) that is attached on the front wall (11) and the back wall (12). According to the invention, the pair of carrying handles (31) comprises a folding line (15) in the filling space (14), such that the pair of carrying handles (31) can be brought into a usage position (1) and in a rest position (2), wherein in the rest position (2) the pair of carrying handles (31) is entirely folded back inside the filling chamber (14) and in the usage
(Continued)

position (1) the pair of carrying handles (31) protrudes at least in certain areas from the filling space (14).

9 Claims, 5 Drawing Sheets

(51) Int. Cl.
*B31B 1/86* (2006.01)
*B65D 33/00* (2006.01)
*B65D 33/04* (2006.01)

(52) U.S. Cl.
CPC ..... *B65D 33/007* (2013.01); *B65D 33/04* (2013.01); *B65D 33/105* (2013.01); *B31B 2219/908* (2013.01); *B31B 2221/20* (2013.01); *B31B 2221/40* (2013.01); *B31B 2221/60* (2013.01)

(58) Field of Classification Search
CPC ..... B31B 2219/908; B31B 2221/20; B31B 2221/40; B31B 2221/60
USPC ..... 383/6
See application file for complete search history.

(56) References Cited

U.S. PATENT DOCUMENTS 3,464,325 A * 9/1969 Class ..... B31B 19/86 383/6
3,483,801 A * 12/1969 Kupcikevicius ..... A22C 11/127 223/31
3,486,421 A * 12/1969 Franson ..... B31B 1/00 493/221
3,494,264 A * 2/1970 Class ..... B31B 19/86 493/223
3,564,983 A * 2/1971 Grimm ..... B65C 5/06 493/323
3,575,339 A * 4/1971 Kupcikevicius ..... A22C 11/127 206/525
3,613,523 A * 10/1971 Wesselmann ..... B31B 19/86 156/443
3,722,377 A * 3/1973 Hayes ..... B31B 19/86 383/14
4,510,620 A * 4/1985 Langen ..... B31B 19/86 383/14
4,545,414 A * 10/1985 Baum ..... A45C 1/04 150/107
5,062,717 A * 11/1991 Shockley ..... A45C 3/04 383/104
5,328,266 A * 7/1994 Davis ..... B65D 33/105 383/14
5,346,708 A * 9/1994 Carson ..... B65D 33/06 206/497
5,370,461 A * 12/1994 Smith ..... B65D 33/20 383/14
5,382,215 A * 1/1995 Mattiebe ..... B31B 19/86 493/221
5,421,805 A * 6/1995 Baxter ..... B31B 19/86 493/226
D378,024 S * 2/1997 Tucker ..... D3/303
5,609,556 A * 3/1997 Rostalski ..... B31B 19/86 493/226
5,816,993 A * 10/1998 Fowler ..... B31B 19/86 493/221
5,836,695 A * 11/1998 Hanson ..... B65D 33/105 383/14
6,059,709 A * 5/2000 Achelpohl ..... B31B 19/86 493/226
6,374,461 B1 * 4/2002 Gober ..... B65D 33/06 16/114.1
6,705,317 B2 * 3/2004 Castiglione ..... A62B 18/084 128/205.25
6,932,754 B2 * 8/2005 Fujishiro ..... B31B 19/86 493/186
8,597,168 B2 * 12/2013 Koesters ..... B31B 23/00 493/221
8,715,148 B2 * 5/2014 Totani ..... B31B 19/86 493/221
8,764,618 B2 * 7/2014 Castro ..... B31B 1/00 493/243
8,790,230 B2 * 7/2014 Piraneo ..... B31B 21/00 493/186
2006/0188180 A1 * 8/2006 Otsubo ..... B65D 33/001 383/35

FOREIGN PATENT DOCUMENTS

| | | |
|---|---|---|
| DE | 4238655 | 5/1994 |
| DE | 9403188 | 6/1995 |
| EP | 0781710 | 7/1997 |
| FR | 1370903 | 8/1964 |
| JP | 2007-314244 | 12/2007 |
| WO | WO 2014/187582 | 11/2014 |

OTHER PUBLICATIONS

International Search Report and the Written Opinion dated Jun. 3, 2014 From the European Patent Office Re. Application No. PCT/EP2014/053758 and Its Translation of Search Report in English.
Pruefungsantrag [Request for Examination] dated Feb. 10, 2014 From the Deutsches Patent—und Markenamt [German Patent and Trademark Office] Re. Application No. 102013105381.5.

* cited by examiner

BAG, METHOD FOR THE PRODUCTION OF A BAG AND MACHINE SYSTEM FOR THE PRODUCTION OF A BAG

RELATED APPLICATIONS

This application is a National Phase of PCT Patent Application No. PCT/EP2014/053758 having International filing date of Feb. 26, 2014, which claims the benefit of priority of German Patent Application No. 10 2013 105 381.5filed on May 24, 2013. The contents of the above applications are all incorporated by reference as if fully set forth herein in their entirety.

FIELD AND BACKGROUND OF THE INVENTION

The invention relates to a bag comprising a front wall and a back wall arranged parallelly to the front wall, a bottom that can be folded into the plane of the walls such that a filling chamber results that is open on one side and a pair of carrying handles that is attached on the front wall and the back wall. Further, the invention relates to a method for the production of a bag with a front wall and a back wall arranged parallelly to the front wall, a bottom that can be folded into the plane of the walls such that a filling chamber results that is open on one side and a pair of carrying handles that is attached on the front wall and the back wall. Further, the invention relates to a machine system for the production of said bag.

From document EP 0 781 710 A1 a bag is disclosed with a carrying handle, wherein the bag comprises two parallel walls and a foldable bottom in the plane of the walls. Both carrying handles comprise each two parallel legs and a bridge connecting these legs. Further, the carrying handles comprise fastening sections at their legs which are attached at the outer walls of the bag whereby the actual attachment of the carrying handles is achieved. Further, the carrying handle comprises folding lines so that the carrying handle can be folded back so that in the folded bag state both carrying handles do not exceed the walls of the bag.

Although in this manner the configuration of a compact stack or package from flat bags lying on top of one another is enabled, but during stacking a relatively high material composition results in the area of the pairs of carrying handles which are assembled at the outside of the back. Hereby, the stacking of the bags and the packaging to a compact package is complicated. Further, it has turned out that during the production of the pairs of carrying handles avoidable waste results.

SUMMARY OF THE INVENTION

The object of the present invention is to avoid the previously described disadvantages, particularly to establish a bag and a method for producing a bag and a machine system for producing bags by which the bags can be stacked more easily and the configuration of compact stacks or packages is enabled. Further, the efficiency for the production of the bags should be increased.

According to the invention it is intended that the pair of carrying handles can be turned into a usage position and a rest position wherein in the rest position the pair of carrying handles is completely folded back within the filling chamber and in the usage position the pair of carrying handles at least partially extends from the filling chamber wherein the pair of carrying handles comprises a folding line which is in the usage position assembled in or at the filling chamber. A main advantage of the invention is that in the rest position of the pair of carrying handles a very flat bag is achieved in a folded up state which requires a low material composition during stacking of the bags. The pair of carrying handles is according to the invention configured flat and therewith supports a small transport volume. A further advantage of the pair of carrying handles folded within the filling chamber is that during the transport or during stacking of the bags there is no risk that the pair of carrying handles is damaged.

In a further measure improving the invention it can be intended that the pair of carrying handles comprises two handles which are assembled at the front wall and the back wall within the filling chamber wherein one handle is assembled at the inner side of the front wall and the other handle is assembled at the inner side of the back wall. Advantageously, the handles form aligning handle openings in their usage position wherein the carrying comfort for the user is significantly improved. Further, it is possible that each handle is configured from multiple material layers wherein the pair of carrying handles is materially reinforced.

Further, it is possible that the handle is part of a carrying element which is assembled at the inner side of the front wall and/or at the inner side of the back wall. Within the scope of the bag according to the invention the invention comprises that this carrying element is designed as a piece of paper. It is particularly advantageous that this carrying element can be produced cost efficiently, wherein at the same time an attachment at the inner side of the carrying element at the front wall and at the back wall can be performed quickly.

Further, the invention can intend that the pair of carrying handles is assembled in a material bond manner at both walls wherein particularly a hot glue connection or a cold glue connection exists. The hot glue can comprise at least one of the following ingredients: basis polymer, resin, stabilizers, wax, nucleation means. As basis polymer for example PA (polyamide), PE (polyethylene), APAO (amorphous polyalphaolefin), EVAC (ethylene vinyl acetate copolymers), TPE-E (thermoplastic polyester elastomers), TPE-U (thermoplastic polyurethane elastomers), TPE-A (thermoplastic copolyamide elastomers). As resin for example colophony and/or terpenes and/or hydrocarbon resins can be used. According to the invention for the stabilizers for example antioxidants and/or metal deactivators and/or light stabilizers can be used. According to the nucleation means it is possible according to the invention to add these for the modification of semi-crystalline plastics. These serve for the fact that the crystallization occurs at higher temperature. By using the hot glue the advantage results that different materials can be glued to one another. Further, unevenness of to be glued surfaces can be easily compensated.

An advantage during usage of a cold glue is that high speeds of the machines can be achieved by the cold glue technique. Further, the cold glue can be applied relatively easily.

The bag according to the invention can comprise a carrying element in a possible embodiment which is punched out or lasered or perforated in a way that the handle can be folded out of the carrying element. A main advantage of this embodiment is that during the production of the pair of carrying handles no waste applies. In the rest position the handle is completely integrated in the carrying element and more or less configures a unit. Advantageously, the carrying element hereby comprises a flat form which requires little volume within the bag.

Likewise it is possible according to the invention that the carrying element is assembled evenly to the edge of the front wall and/or the back wall, wherein the edge is assembled opposite to the bottom. It has turned out that by such a measure the stacking of the bags can be improved according to the compactness. For example it is possible that the carrying element is shaped rectangularly and/or squarely. Further; it can be meaningful in some applications according to the bag that the carrying element comprises a material thickness which is greater than the thickness of the front wall and/or the back wall. Alternatively and/or additionally, the invention comprises that the carrying element is configured from a materially reinforced and/or fabric reinforced paper and/or tissue and/or fleece or from a plastic. According to the invention the carrying element can comprise a weight of approximately 200 g/m$^2$ to 300 g/m$^2$. According to the invention the carrying element can comprise a weight of less than 200 g/m$^2$ preferably a weight of less than 100 g/m$^2$, particularly preferred a weight of less than 65 g/m$^2$. A further advantage is that the carrying element serves as an edge reinforcement for the bag which is invisible from the outside. Likewise it is possible that the carrying element is assembled spaced apart from the edge of the front wall and/or back wall.

The folding line can also be assembled at the edge of the front wall and/or back wall. Likewise here the present invention has to be understood as that the folding line of the pair of carrying handles is within the filling chamber. The folding line can also only rise when the pair of carrying handles is transferred from the rest position into the usage position as a bending line. The folding line can also raise already during the production process of the bag or can be prebroken for example when the carrying element rises with the pair of carrying handles previous to applying the carrying element to the material web.

Further, the bag according to the invention comprises the feature that at the edge of the front wall or the bag wall an opening aid is configured, particularly that the opening aid is configured as a recess. In order to use the folded-up bag the user can use the opening aid in order to easily push the bag in the direction of the front wall and/or back wall so that for example objects can be put into the filling chamber. The geometry of the opening aid can be semi-circular so that for example a thumb or fingers can be purposefully guided through the opening aid. Further, geometric designs of the opening aid are possible.

Further, it is possible that the edge is perforated and/or felted and/or frayed. The circumferential edge of the bag is therewith configured bluntly without the fact that a risk of cutting at the edge of the bag occurs for the user. Advantageously, the bag is configured from a paper material and can be used in different manners in form of a flexible bag. The specially configured edge can according to the invention be configured microscopically felt-like, whereby a relatively "soft" edge occurs. According to the invention the edge can be configured perforation-like, this means that for example via a tear off process this edge results at the bag.

The handle of the bag according to the invention can comprise the form of an advertising media particularly the handle can be configured M-like. This advertising media can for example indicate the content of the bag or can provide a mark reference to the user.

The invention also comprises that the front wall and/or the back wall comprise a window or viewing strip or a net. The window is preferably configured from a transparent material. The transparent material makes it possible that the user can at least partially have an inside into the cavity of the bag.

Additionally, it can be intended according to the invention that between the front wall and the back wall at least one lateral folding proceeds. The lateral folding can comprise one or multiple lateral folds. Advantageously, the lateral folding extends starting from the opening or the edge of the bag into the direction of the bottom. The function of the lateral folding is that the filling chamber or the cavity within the bag can be reliably enlarged by the user pushing apart the front wall and the back wall. In the not used state of the bag both walls can lie on top of one another wherein the lateral folds can be assembled between both walls.

The bottom of the bag according to the invention can be configured as a cross bottom or a block bottom or a flat and lateral folding bottom or as a seam bottom or as a pinch bottom. An advantage in the usage of the cross bottom is that a big space can be established at the front wall and the back wall of the bag wherein the filling volume can be enlarged. Further, the bag provides a bigger "face" at the outside walls in order to for example serve as an information carrier and/or advertising media. A particular advantage of the block bottom is hereby that the standing property of the bag is improved by such a bottom, particularly when the bottom comprises lateral foldings.

Further, the previously described object is solved by a method for the production of at least one bag, wherein the bag is configured with a front wall and a back wall arranged parallelly to the front wall, wherein further the bag comprises a bottom that can be folded into plane of the walls so that a filling chamber results that is open on one side. Further, the bag comprises a pair of carrying handles which are assembled at the front wall and at the back wall wherein the method according to the invention comprises the following steps:

a) Assembly of two carrying elements spaced apart one from another at a translationally moving material web wherein at the carrying element at least one foldable handle is integrated,
b) Tube configuration of the material web so that the material web configures a tube and the carrying elements are lying on top of one another,
c) Separation of the material web so that single tube sections result with at least two carrying elements lying on top of one another which are lying within the tube,
d) Folding of the tube so that at least one bottom results.

A bag results which comprises the advantages which are already described concerning the bag according to the invention related to the independent claim 1. Further, the method according to the invention is characterized by a great production efficiency regarding the quantity of the bags which are producible. The material web can likewise be a single material sheet, particularly a paper sheet which comprises a beginning and an end.

Advantageously, it is possible that step d) occurs previous to step c) what means that previous to a separation of the material web a folding of the bottom can occur. This is for example possible when the bottom is folded as a block bottom bag or as a cross bottom bag.

Advantageously, previous to step b) an opening aid can be configured at the edge of one of both carrying elements, particularly the opening aid can be configured as a material recess in the carrying element and in the material web. Therewith it can be achieved that only one of the two back walls is configured with an opening aid.

Further, the method according to the invention can be configured in way that the carrying element comprises two foldable handles which are assembled one behind the other in step a) in the direction of the material web movement. Hereby, the efficiency for the production of the bags can be doubled. Further, it is possible that previous to step b) an opening aid is applied in the centre of one of both carrying elements, particularly that the opening aid is configured as a material recess in the carrying element and in the material web. Hereby, a hole punch or a circle hole punch can effect this material recess. The geometry of the recess can for example be: circular, oval, squared, angular, rectangular, polygonal.

Alternatively and/or additionally the method can according to the invention be configured in a way that the carrying elements lying on top of one another according to step b) are adjusted or assembled perpendicular to the material web movement direction during the application to the material web according to step a).

In case of a carrying element with two foldable handles it is an advantage when in step d) two bottoms are folded lying oppositely to one another and subsequently the established tube is severed in the centre with bottoms and carrying elements so that two bags result. Therewith the efficiency can be doubled since in one process cycle two bags result at the same time.

In a further embodiment of the invention it can be possible to assemble a perforation line on the material web movement direction perpendicular to the material web movement direction subsequently to step a) or previous step b). Particularly a perforation line can make sense in case the bottom is folded as a flat or lateral folded bottom.

According to the invention the carrying element can previously to step a) be punched or perforated or lasered in a way that at least one foldable handle from the carrying element results. Likewise it is possible that in one carrying element two foldable handles result. Further, it has to be noted that no material waste results which is advantageously regarding environmental aspects.

Advantageously, the transport direction of the material web or the tube or the tube section in step a) to step b) or to step c) is perpendicular to the transport direction for step d) and/or for the step for severing the tube which comprises two opposing bottoms. It is encompassed that the transport directions which are perpendicular to one another can also be on top of one another.

It is particularly advantageous that the transport direction of the material web or the tube or the tube section in step d) is transverse to the longitudinal direction of the bag whereby the efficiency during the folding of the bottom can be improved.

Further, the described object is taken into account by a machine system for the production of a bag with a front wall and a back wall arranged parallelly to the front wall, a bottom that can be folded into the plane of the walls so that a filling chamber results that is open on one side and a pair of carrying handles that is attached on the front wall and the back wall within the filling chamber. Hereby, the machine system comprises the following aggregates or machine components:

a) Device for application of at least one pair of carrying handles to a material web,
b) Tube configuration device with which the material web can be brought into the form of a tube,
c) Separation device with which the tube-like material web can be dissociated into tube sections in a way that the pair of carrying handles remains covered within the tube section,
d) Bottom layer with which at least one bottom is foldable at the tube.

Advantageously, according to a), the device can be suitable to apply two pairs of carrying handles to the material web wherein according to d) the bottom layer can be suitable to fold two opposing bottoms wherein a dissociation device can be intended with which the established tube section with bottoms and carrying elements can be centrically separated so that two bags can result. For example the dissociation device can perform an edge cut so that a blunt, not cutting edge results at the bag. Likewise it can be intended that the cut is configured by a dissociation device in a way that a perforated edge or a felted edge or a frayed edge results wherein likewise the risk of injury at the edge is minimised. The bottom layer can be configured as a bottom configuration unit which can advantageously be also integrated in a separate aggregate of the machine system. Alternatively, a smooth edge is possible which can for example be used in a light bag material without the danger that an injury at the edge results for the user.

Further, the machine system according to the invention can be improved in a way that the device according to a) is suitable to assemble an opening aid at one of both carrying elements, particularly that the opening aid is configured as a material recess in the carrying element and in the material web. As long as the material web is not yet configured as a tube it is particularly advantageous to equip one of both carrying elements with the opening aid. Likewise it can be alternatively possible to integrate the function in the tube configuration aggregate according to b) or in the aggregates for the separation of the material web or in the bottom layer to assemble an opening aid in the carrying element.

The machine system according to the invention comprises the possibility that the device according to a) and the tube configuration device and the separation device and the bottom layer are integrated within one aggregate. This can particularly be realized when the machine system works without dissociation device by which in the device for the application of a pair of carrying handles to a material web a carrying element is used in which only one foldable handle is integrated.

Alternatively, it is possible that the device according to a) and the tube configuration device and the separation device are integrated in the first aggregate and that the bottom layer and the dissociation device are integrated in a second aggregate. Such an assembly can be an advantage when according to the device for application of the pair of carrying handles to a material web a carrying element is used in which two foldable handles are integrated which are assembled one behind the other in the direction of the material web movement.

With said machine system all method steps can be realized which are claimed in the method claims. The machine system can further produce a bag.

BRIEF DESCRIPTION OF THE SEVERAL VIEWS OF THE DRAWINGS

Further advantages, features and details of the invention result from the subsequent description in which multiple embodiments are described in detail in relation to the drawings. Thereby, the features described in the claims and in the description can be essential for the invention each single for themselves or in any combination. It is shown:

DESCRIPTION OF SPECIFIC EMBODIMENTS OF THE INVENTION

Figure 4:
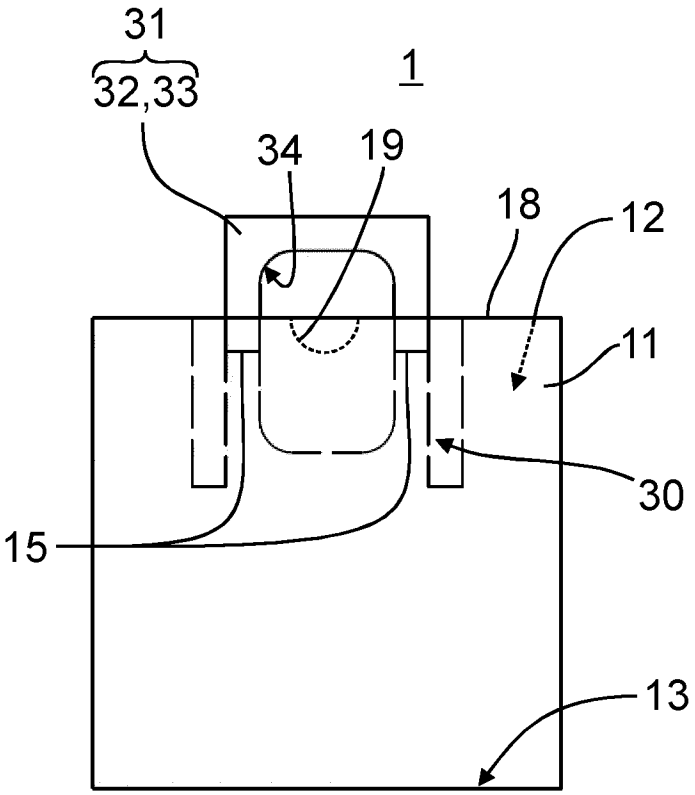
Figure 5:
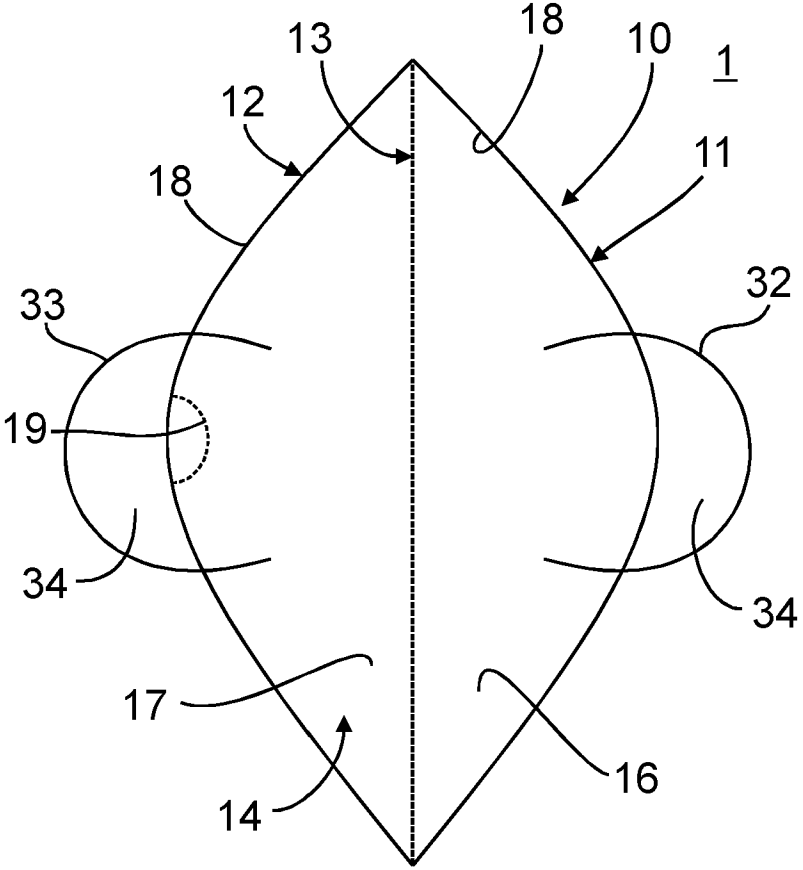

In FIGS. 3, 4, 5, 6, 7 and 8, possible embodiment alternatives of a bag 10 according to the invention are shown. In the not yet usage of the bag 10, namely after its production or in its transport state, the bag 10 is folded up flatly which is for example shown in FIGS. 1, 3, FIG. 4 and FIG. 6. In this state the front wall 11 and the back wall 12 of the bag 10 are lying directly on top of one another wherein the bag 10 comprises a foldable bottom 13 in the plane of the walls 11, 12. If now the user wants to use this bag 10 both walls 11, 12 can be folded apart so that a filling chamber 14 results open at one side which is shown in FIG. 5.

Further, the bag 10 comprises a pair of carrying handles 31 which are assembled at the inner sides 16, 17 of the walls 11, 12. Hereby, the pair of carrying handles 31 comprises two handles 32, 33, which are assembled within the filling chamber 14 at the inner sides 16, 17 of the front wall 11 and the back wall 12. This is among others shown in FIGS. 3, 4 and 5.

Figure 1:
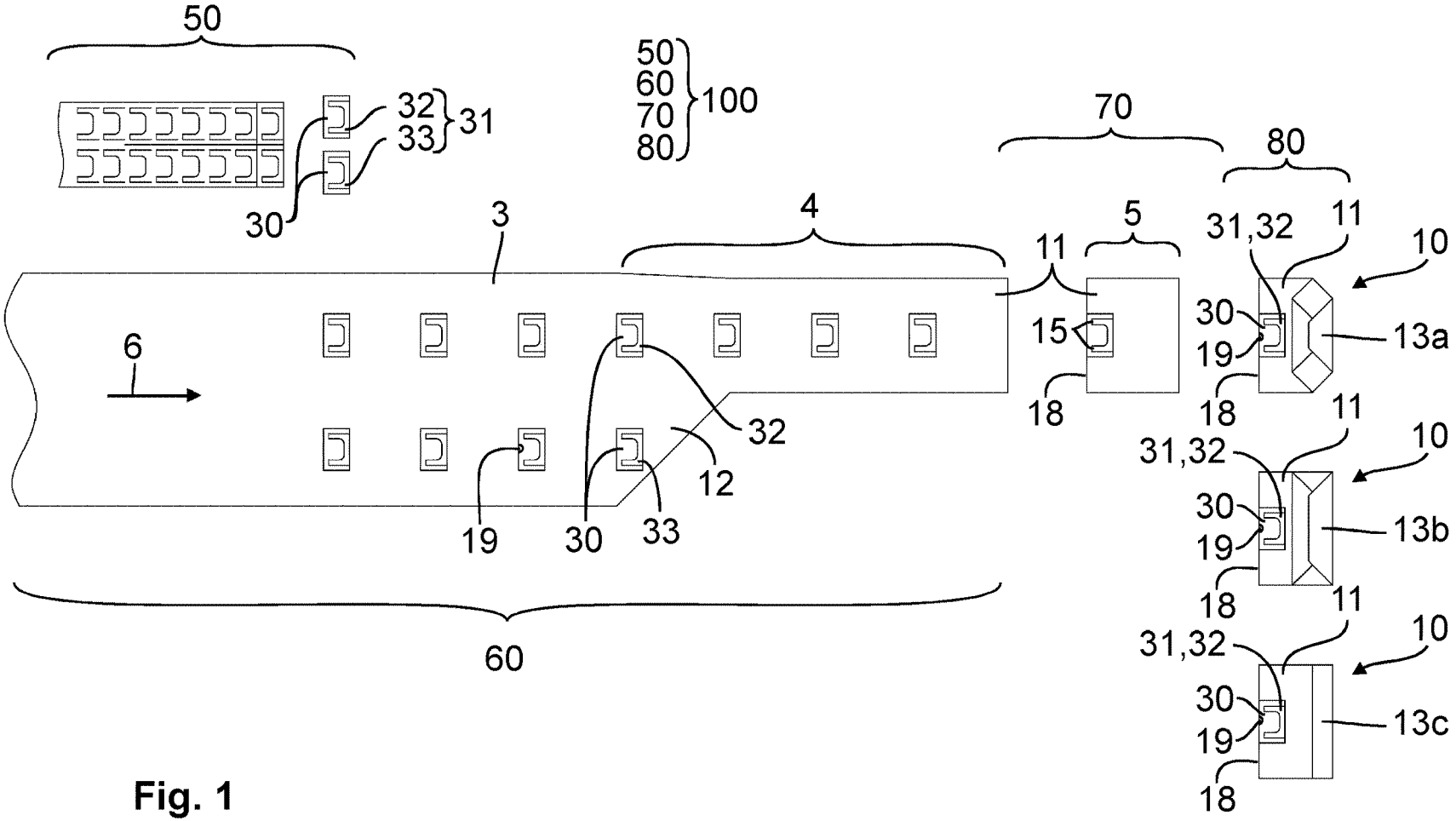
FIG. 1 a schematic view for the production of a bag.
Figure 2:
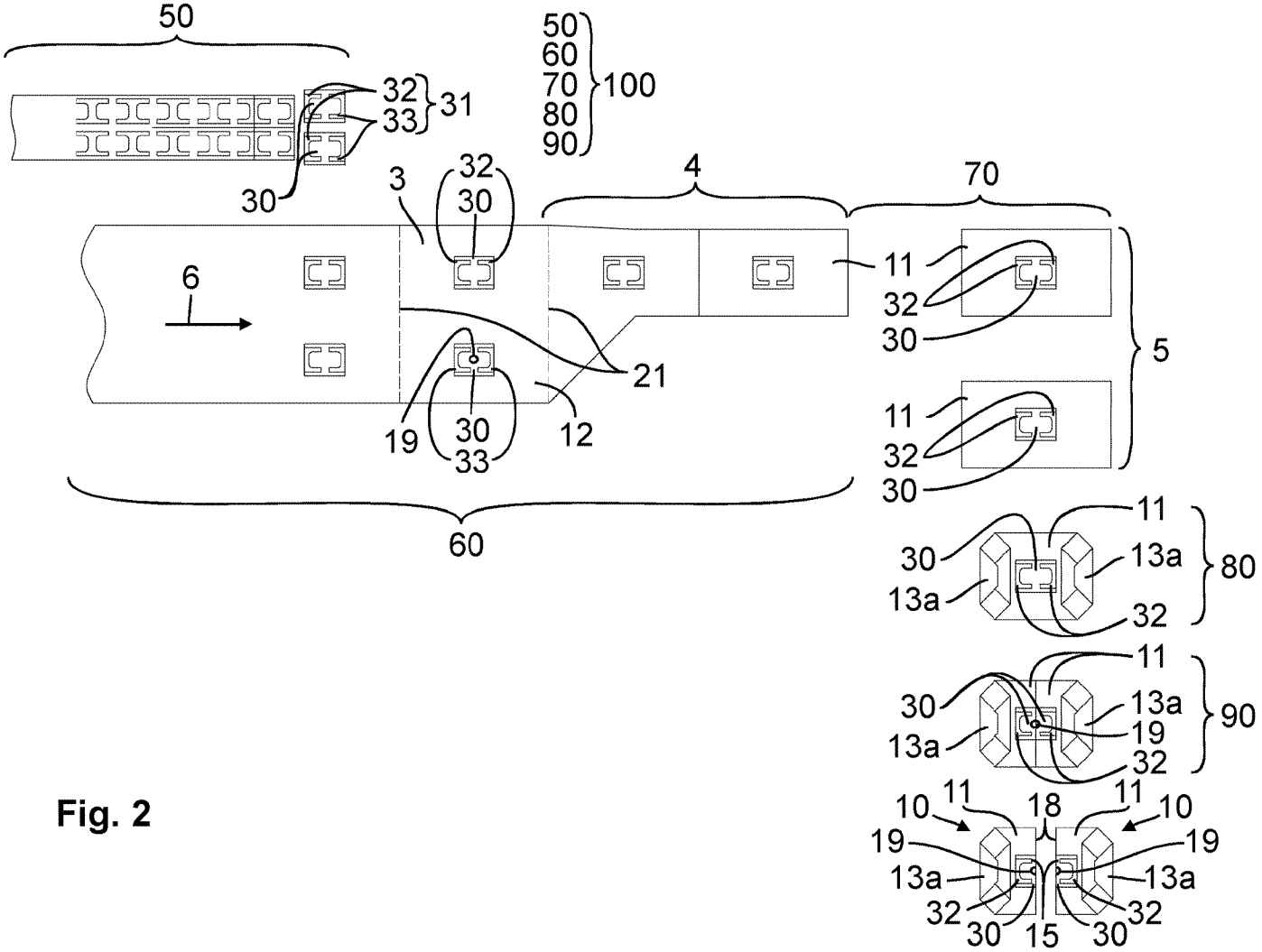
FIG. 2 a further alternative for the production of a bag.
Figure 3:
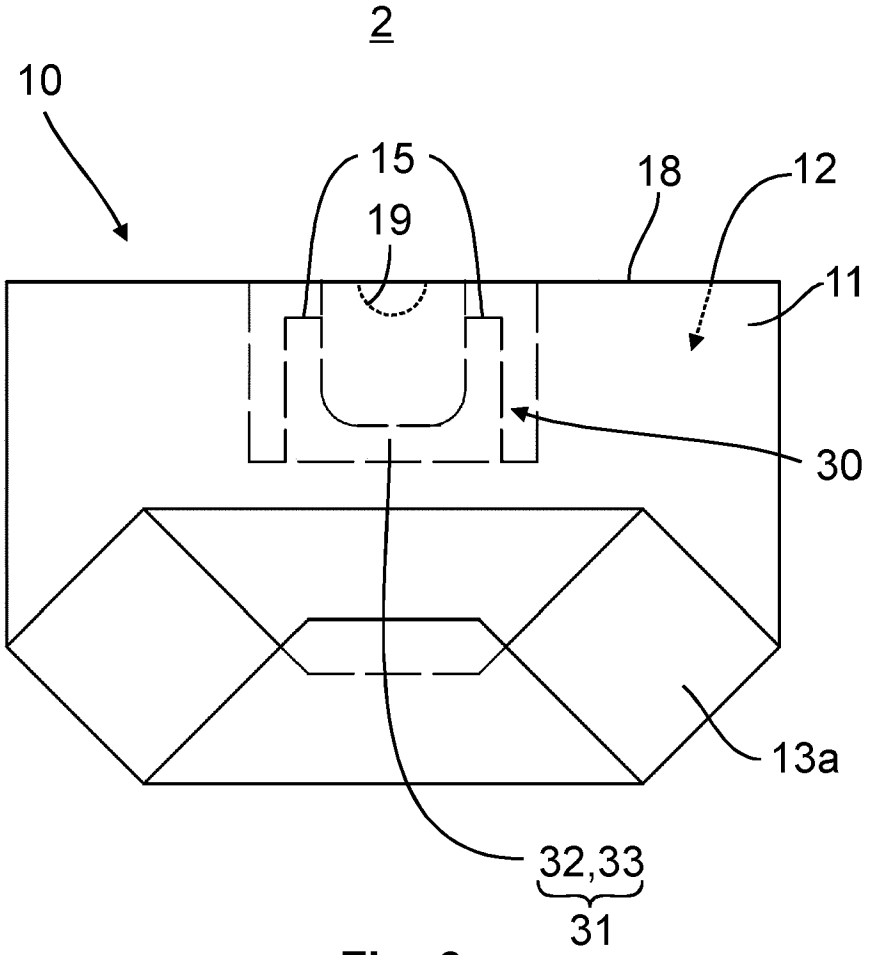
FIG. 3 a bag with a pair of carrying handles which is completely within the filling chamber of the bag, FIG. 4 bag according to the invention according to FIG. 3 wherein the pair of carrying handles is outside the filling chamber of the bag, FIG. 5 a schematic top view of a bag according to the invention, FIG. 6 a further embodiment of a possible bag, FIG. 7 a further embodiment of a possible bag, and FIG. 8 a further embodiment alternative of the bag according to the invention.

Each handle 32, 33 is part of a carrying element 30 which is likewise shown in FIG. 1 and FIG. 2. In the shown embodiment the carrying element 30 can be configured as a piece of paper. Hereby, the carrying element is punched out or lasered or perforated in a way that the handle 32, 33 can be folded out of the carrying element 30 which is schematically shown in FIGS. 3 and 4. In FIG. 3 the pair of carrying handles 31 is in a resting position 2 in which the pair of carrying handles 31 is completely within the filling chamber 14. According to FIG. 4 the usage position 1 of the pair of carrying handles 31 is shown in which the pair of carrying handles 31 extends from the filling chamber 14.

The pair of carrying handles 31 comprises a folding line 15 which is in the filling chamber 14 wherein the folding line 15 can be also localized at the edge 18 of the bag 10 or at the front wall 11 or the back wall 12. In the latter embodiment the folding line 15 is according to the idea of the invention in the filling chamber 14.

According to the shown embodiment the carrying element 30 is assembled evenly to the edge 18 of the front wall 11 and the back wall 12. It is possible that the carrying element 30 can also be assembled spaced apart from the edge 18 inside of the bag 10. The edge 18 is hereby on the opposing side of the bottom 13. According to FIGS. 1, 2, 3, 4, 5, and 8, the carrying element 30 is configured rectangularly. The handle 32, 33 hereby represents a part of the carrying element 30 which is assembled in a material bond manner at the inner side 16, 17 of the walls 11, 12 in the shown embodiment. Hereby, a hot glue connection or cold glue connection can be used.

According to FIG. 1 and FIG. 2 the bag 10 can comprise a recess 19 at the edge 18 of the front wall 11 or the back wall 12 which serves as an opening aid in order to fold the folded bag 10 apart in order to guide and place objects into the filling chamber 14. The opening aid 19 is configured semi-circularly in the shown embodiment. So that during the folding apart of the bag 10 the user does not experience an injury at the edge 18 of the walls 11, 12 of the bag 10, the edge 18 is configured "blunt" this means that the edge 18 is for example perforated and/or felted and/or frayed.

Figure 8:
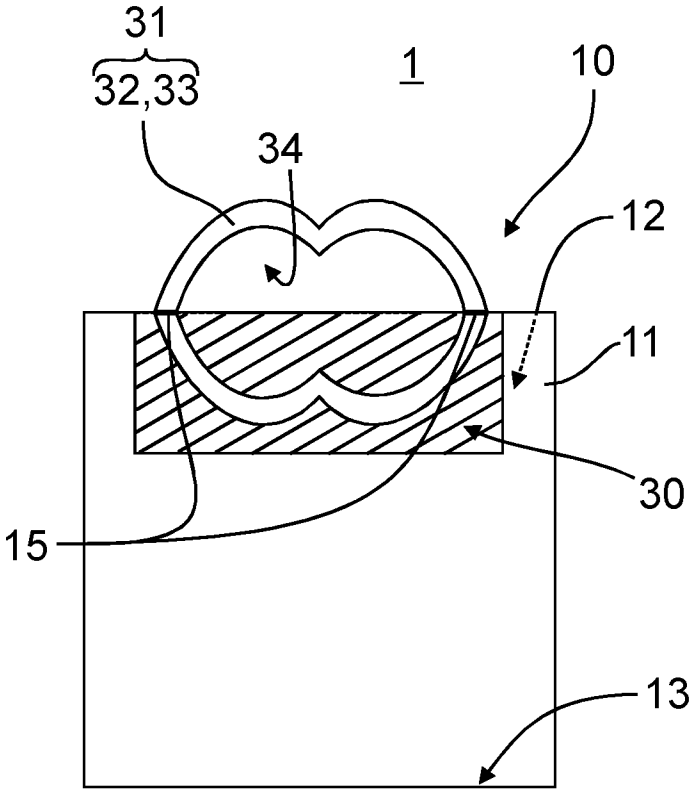
Figure 7:
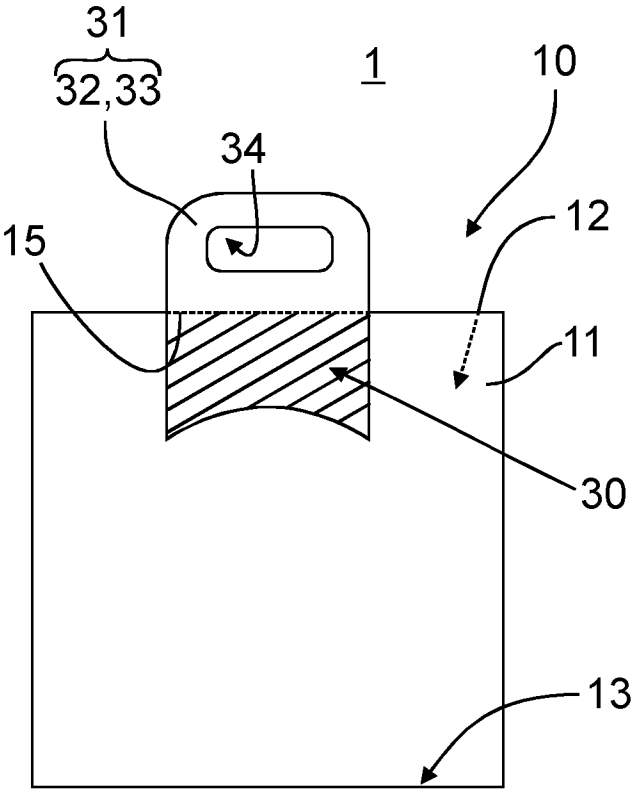

The handle 32, 33 or the pair of carrying handles 31 can comprise diverse geometric forms wherein the handle 32, 33 can comprise the form of an advertising media which is for example shown in FIG. 8. Here the handle 32, 33 comprises an M-like shape. Further, each embodiment of the invention comprises a pair of carrying handles 31 which comprise a handle opening 34 so that the user can reliably grab the pair of carrying handles 31 in the usage position 1 of the handles 32, 33.

Figure 6:
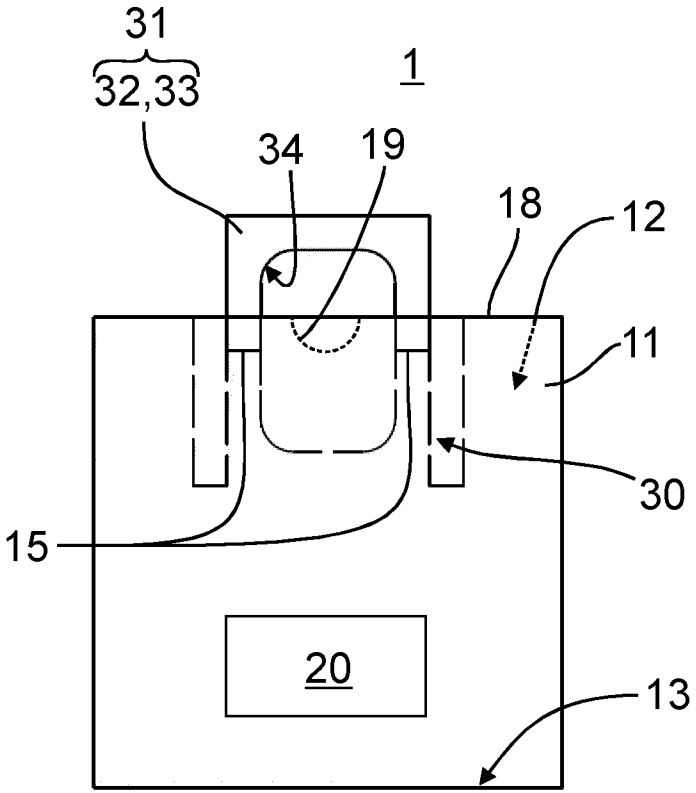

In FIG. 6 it is shown that the bag 10 can comprise a transparent window 20 at the front wall 11 and/or back wall 12 so that the user can look into the filling chamber 14. The bottom 13 of the bag 10 can be configured differently, for example it is possible that the bottom 13 according to FIGS. 1 and 2 can be configured as a cross bottom 13*a* or a block bottom 13*b* or as a flat and lateral folding bottom 13*c*. The carrying element 30 can be configured from a material reinforced and/or fabric reinforced paper and/or tissue and/or fleece. Likewise it is possible that the carrying element 30 can be configured from a plastic. The bag 10 is configured from a paper material in the shown embodiments. It is possible that the carrying element 30 comprises a weight of approximately 200 $g/m^2$ to 300 $g/m^2$.

According to FIG. 1 and FIG. 2 a bag 10 can be configured or produced which is for example shown in FIGS. 3, 4. 5, 6, 7 and 8. In FIG. 1 and FIG. 2 initially in a device 50 the production of a carrying element 30 occurs with foldable handles 32, 33. In FIG. 1 each carrying element 30 comprises a foldable handle 32, 33. In FIG. 2 each carrying element 30 comprises two handles 32, 33 assembled on opposing sides. In the device 60 an assembly of two carrying elements 30 spaced apart from another occurs at the translational moving material web 3 from which the bag 10 is produced. The material web 3 moves in the direction of the arrow which has the reference sign 6. In the device 60 further the tubular configuration of the material web 3 occurs so that the material web 3 configures a tube 4 and the carrying elements 30 are assembled on top of one another within the tube 4. Subsequently, in the separation device 70 a separation of the material web 3 occurs so that single tube sections 5 arise with two carrying elements 30 lying on top of one another which are lying within the tube 4 and are in contact with one another. In the subsequent bottom layer 80 (bottom configuration unit) a folding of the tube 4 or the tube section 5 can occur so that according to FIG. 1 a bottom 13 and according to FIG. 2 two bottoms 13 result.

According to FIG. 1 it is also possible that initially a bottom layer 80 is getting active at the material web 3 subsequently to the device 60 and a bottom 13 is folded at the tube 4 before subsequently a separation of the material web 3 occurs.

In dependence from the bottom layer 80 different bottom forms like cross bottom 13*a*, block bottom 13*b* or flat and lateral folding bottom 13*c* can be folded which can naturally be seen in FIG. 2. According to FIG. 1 a production cycle is ended after the bottom layer 80 so that as an end product the bag 10 results. According to FIG. 2 a central separation of the tube section 5 through both carrying elements 30 occurs subsequently to the bottom layer 80 so that subsequently two bags 10 result.

In the device 60 it can be likewise intended that a perforation line 21 is applied perpendicular to the material web 3 in the material movement direction 6. The perforation line 21 can serve for supporting the separation and the device 70.

Within the device 60 the opening aid 19 can be assembled at the edge of one of both carrying elements 30 wherein in the present embodiment according to FIG. 1 and FIG. 2 the opening aid 19 is configured as a material recess in the carrying element 30 and in the material web 3. This is due to the fact that in the dissociation device 90 a central separation of the tube section 5 which is provided with a bottom 13 at both sides occurs by the recess 19. Subsequently, both bags 10 comprise an opening aid 19 which corresponds to the opening aid 19 according to FIG. 1. Only the efficiency during the production of the bag 10 in FIG. 2 can be doubled.

According to FIG. 1 all aggregates 50, 60, 70, 80 within one aggregate (=machine unit) of the machine system 100 can be integrated. According to FIG. 2 it is possible that the device 50 and/or 60 and 70 are integrated in the first aggregate and that the bottom layer 80 and the dissociation device 90 are aggregated in a second aggregate. The dissociation device 90 can also be integrated in a separate aggregate.

REFERENCE LIST

1 Usage position
2 Rest position
3 Material web
4 Tube
5 Tube section
6 Material web movement direction
10 Bag
11 Front wall
12 Back wall
13 Bottom
13*a* Cross Bottom
13*b* Block Bottom
13*c* Flat and lateral folding bottom
14 Filling chamber
15 Folding line
16 Inner side of 11
17 Inner side of 12
18 Edge
19 Opening aid, material recess
20 Window
21 Perforation line
30 Carrying element
31 Pair of carrying handles
32 Handle
33 Handle
34 Handle opening
50 Device
60 Tube configuration device
70 Separation device
80 Bottom layer
90 Dissociation device
100 Machine system

What is claimed is:

1. Method for the production a bag, with a front wall and a back wall arranged parallelly to the front wall, a bottom that can be folded into the plane of the walls so that a filling chamber results that is open to one side and a pair of carrying handles that is attached on the front wall and the back wall, wherein:

a) Assembly of two carrying elements spaced apart from one another at a translationally moving material web, wherein at the carrying element at least one foldable handle is integrated, b) Tube configuration of the material web so that the material web configures a tube and the carrying elements are lying on top of one another, c) Separation of the material web so that single tube sections result with at least two carrying elements lying on top of one another entirely within the tube, d) Folding of the tube so that at least one bottom results; wherein step d) occurs previous to step c).

2. Method according to claim 1, wherein previous to step b) an opening aid is assembled at the edge of one of both carrying elements.

3. Method according to claim 1, wherein the carrying element comprises two foldable handles which are assembled one behind the other in step a) in the direction of the material web movement.

4. Method according to claim 3, wherein previous to step b) an opening aid is assembled in the centre of one of both carrying elements.

5. Method according to claim 1, wherein the carrying elements which are lying on top of one another according to step b) are aligned and assembled towards one another perpendicular to the material web movement direction during the application on the material web subsequently to step a).

6. Method according to claim 1, wherein that subsequently to step a) or previous to step a) a perforation line is applied to the material web perpendicular to the material web movement direction.

7. Method according to claim 1, wherein that in step d) two bottoms are folded which are opposing one another and subsequently the the configured tube with bottoms and carrying elements is separated in the centre so that two bags result.

8. Method according to claim 1, wherein previous to step a) the carrying element is punched or perforated or lasered in a way that at least one handle results which is foldable from the carrying element.

9. Bag which is produced with a method according to claim 1.

* * * * *